United States Patent [19]

Rowley et al.

[11] 4,073,354

[45] Feb. 14, 1978

[54] EARTH-BORING DRILL BITS

[75] Inventors: David S. Rowley; Bruce H. Walker, both of Salt Lake City; Coy M. Fielder, Granger, all of Utah; Heino J. Rohde, Nienhagen, Germany

[73] Assignee: Christensen, Inc., Salt Lake City, Utah

[21] Appl. No.: 745,087

[22] Filed: Nov. 26, 1976

[51] Int. Cl.[2] ..... E21B 9/36; E21B 13/01

[52] U.S. Cl. ..... 175/329; 175/391; 175/410

[58] Field of Search ..... 175/329, 330, 390, 391, 175/410

[56] References Cited

U.S. PATENT DOCUMENTS

| | | | |
|---|---|---|---|
| 2,268,775 | 1/1942 | Potvin | 175/391 |
| 2,371,490 | 3/1945 | Williams, Jr. | 175/329 |
| 3,135,341 | 6/1964 | Ritter | 175/391 |
| 3,174,564 | 3/1965 | Morlan | 175/330 |
| 3,321,034 | 5/1967 | Webb | 175/390 |
| 3,382,940 | 5/1968 | Stebley | 175/410 |
| 3,709,308 | 1/1973 | Rowley et al. | 175/329 |
| 3,768,581 | 10/1973 | Rederon | 175/329 |
| 3,938,599 | 2/1976 | Horn | 175/329 |
| 3,982,596 | 9/1976 | Vetter | 175/410 |
| 4,006,788 | 2/1977 | Garner | 175/330 |

*Primary Examiner*—James A. Leppink

[57] ABSTRACT

The invention relates to the design of earth boring bits employing shaped preform cutters containing hard abrasive materials such as diamonds.

32 Claims, 13 Drawing Figures

EARTH-BORING DRILL BITS

BACKGROUND OF THE INVENTION

Diamond bits employing natural or synthetic diamonds positioned on the face of a drill shank and bonded to the shank in a matrix of a secondary abrasive, such as tungsten carbide, by means of a metal bond, are well known in the art.

There are two general types: One in which the diamonds usually of very small gage are randomly distributed in the matrix; another type contains diamonds, usually of larger size, positioned in the surface of the drill shank in a predetermined pattern referred to as surface set. (See U.S. Pat. Nos. 3,709,308; 3,825,083; 3,871,840; 3,757,878; and 3,757,879.)

Drill bits formed according to the above procedure are subject to damage when used as bore-hole drill bits. Such damage results from localized destruction of the diamond matrix complex. When this occurs, the useful life of the bit may be terminated and extensive repairs or salvage of the bit is required by separating the diamonds and tungsten carbide from the steel shank.

In a copending application by some of us, Ser. No. 704,424, is described an earth boring diamond bit in which instead of using individual diamond particles distributed either in random orientation in a secondary abrasive matrix, such as tungsten carbide with a metallic bonding agent, or as surface set bits, cutter preforms are employed. The cutter preform may be made as described in U.S. Pat. No. 3,745,623 or by molding mixtures of diamond particles, secondary abrasive particles, and particles of a metallic bonding agent employing the techniques of the above patents in suitable shaped molds, for example, as described in U.S. Pat. 3,745,623 or by the hot press methods described in Pats. 3,841,852 and 3,871,840.

STATEMENT OF THE INVENTION

According to our invention, the face of the bit is formed so as to facilitate the positioning of the preforms in the body of the drill bit, in spaced relation from the part adjacent to the central axis to close to the gage of the bit. The arrangement of the preforms in the bit is such that on rotation of the bit about its axis substantially the entire surface of the earth traversed by the bit on rotation is engaged by the preforms.

In order to arrange the cutters in a pattern, we form the face of the bit in steps extending circumambiently about the face of the bit. In our preferred embodiment the steps extend in a substantially spiral formation from adjacent the center of the bit to close to the gage of the bit. By positioning sockets for the preforms at the corner between rise and a land of the step, the steps form a jig to assure the positioning of the preforms in the desired array.

In order to assure that the preforms can cut without undue stress, the preforms are set at a negative rake and the preforms are backed by an adjacent portion of the steps to take the thrust on the preform cutters imposed during drilling. The cutters may be set with a zero but preferably with a negative side rake, so as to provide for a snowplow effect to move the cutting to the gage of the bit. Bending stresses in the preforms are thus minimized and in a practical sense avoided.

Provisions are made to move the cuttings away from the preforms. The drilling fluid is passed through a central bore to provide a flushing action. For this purpose, channels are provided, intersecting the steps, in fluid communication with the bore. The channels extend across the face of the bit, in front of the cutters, from the central bore to the gage of the bit. While, for some uses, the channels may be omitted, the channels, as in our preferred embodiments, aid in establishing the bit hydraulics to clean the face of the bit. The orientation of the rake and the fluid passing through the channels move the cuttings to the annulus between the bit and bore hole to be carried up the annulus to the surface.

The preform cutters are carried in sockets positioned in the base of the drill bit, preferably in a drill bit coated, for example, with metal-bonded secondary abrasives having a hardness value less than diamonds. Coating of the drill bit with such hard material is conventional, but in such case, the diamonds are mounted as described in the above patents. Preferably, the sockets in the drill are so oriented about the drill bit, and with the preforms so oriented in the sockets, as to give the pattern previously referred to.

The cutters according to our invention are mounted in the sockets formed in the matrix-coated bit. The sockets are formed so as to orient the preforms which are inserted into the sockets, to provide the pattern and rakes described above,. The preforms, may be mounted in receptacles positioned on studs which are inserted in the sockets. The studs and sockets are formed so that on insertion of the preforms in the receptacles, and mounting of the studs in the sockets, the preforms are oriented in the pattern and with the rakes described above.

The arrangements, both that employing preform cutters mounted on studs or positioned in the sockets have the advantage that the cutters may be backed so that they are in compression rather than in tension due to bending.

We prefer to arrange the cutters in an array in the manner and for the purposes described above and more fully described below and to arrange the fluid channels to be positioned in front of the cutter arrays. This arrangement controls the flow pattern across the cutting surface in immediate proximity of the cutters and aids in removing cuttings and flushes them away from the cutters.

One of the advantages of the mounted preform cutters according to our invention is that, on destruction or other damages to a preform, the damaged preform may be removed and replaced without requiring the salvage of the entire bit.

The above design of the diamond bit of our invention is particularly suitable when using synthetic diamonds, such as are employed in the formation of the cutting elements described in U.S. Pat. No. 3,745,623. Such diamonds are weakened to a much greater degree than are natural diamonds at temperatures normally employed in production of drill bits by processes, such as are described in U.S. Pat. Nos. 3,709,308; 3,824,083; and 3,757,879. Such processes entail exposing diamonds to temperatures which are used in the infiltration or hot press processes of the aforesaid patents. The temperatures employed in such procedures are in the order of above about 2000° F., for example, 2150° F. Such temperatures, while suitable for natural diamonds, are excessive for synthetic diamonds and weaken them excessively.

The design of the drill bit of our invention permits the use of synthetic diamonds as well as natural diamonds in that the preforms using synthetic diamonds or natural diamonds may be formed at temperatures suitable for synthetic diamonds as is described in said U.S. Pat. No. 3,745,623.

The design of our invention thus permits the formation of the drill bit body at high temperatures and the formation of the preforms when using natural diamonds by the high temperature methods previously described or when using synthetic diamonds by forming them at lower temperatures, for example, as described in U.S. Pat. No. 3,745,623. Thus the preforms employing, for example, natural diamonds may be formed by the hot press method referred to in U.S. Pat. No. 3,871,840 employing molds of suitable shape to form the preform of the desired geometric configuration.

Other features and objects of the invention will be understood by reference to the drawings of which:

Figure 1:
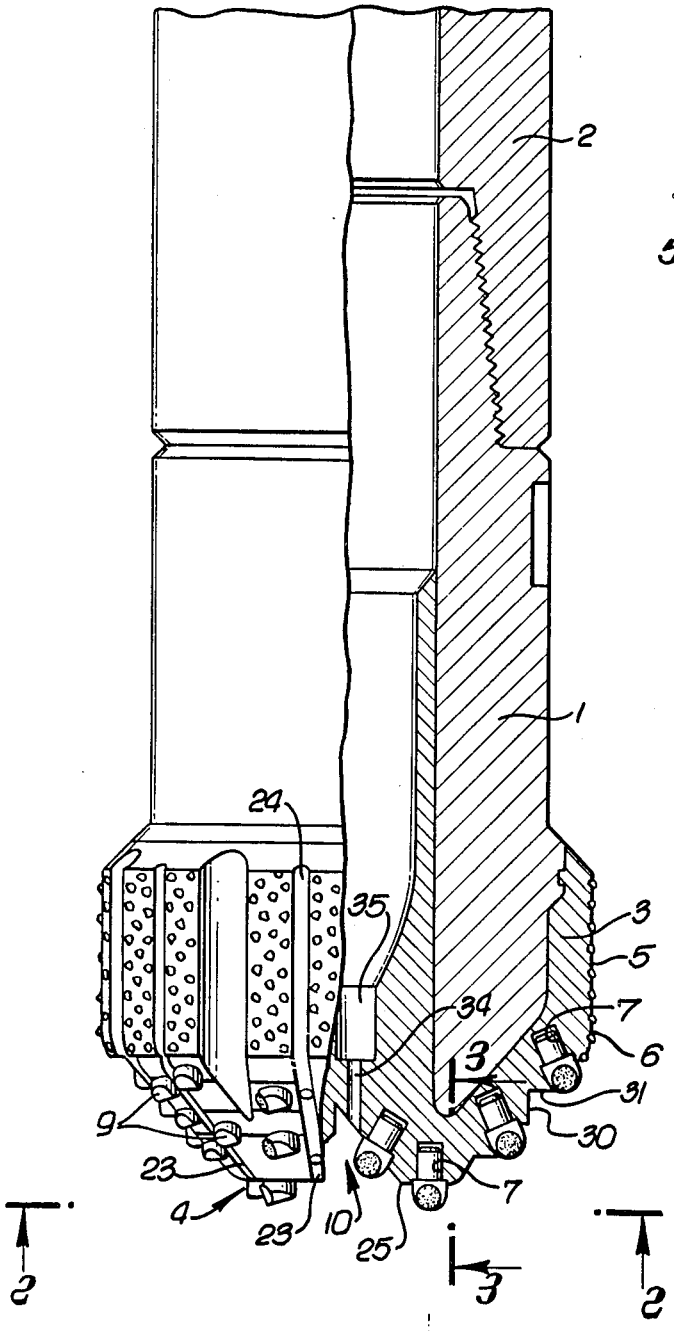
FIG. 1 is a view partly in elevation and partly in quarter section of an earth-boring bit according to our invention.
Figure 4:
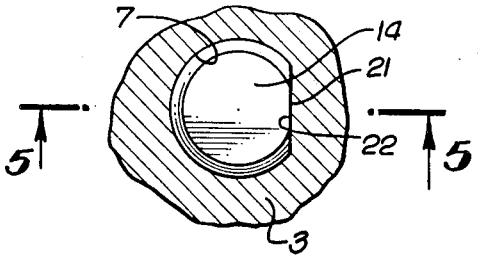
FIG. 4 is a section taken on line 4—4 of FIG. 3.
Figure 5:
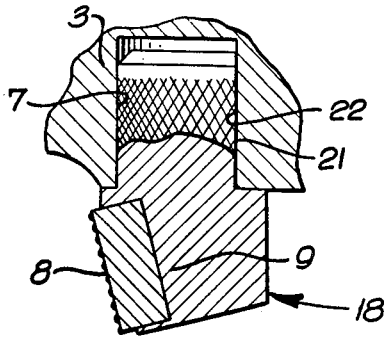
FIG. 5 is a section taken on line 5—5 of FIG. 4.
Figure 8:
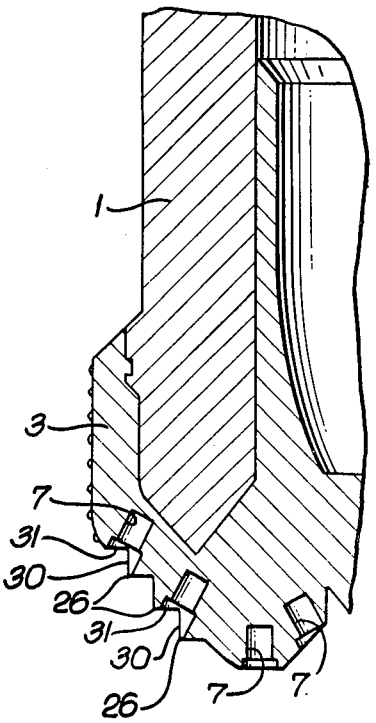
FIG. 8 is a section similar to FIG. 1 prior to installation of the studs.

In FIGS. 1–7, the tubular shank 1 of the bit is of conventional shape and is connected to the drill collar 2 and is coated internally and externally of the shank 1 with a hard material 3, for example, such as metal-bonded tungsten carbide to form the face 4 of the bit section and the stabilizer section 5, as in prior art diamond drill bits used for earth bore-hole drilling. The hard coating 3 of the bit extends circumambiently about the central axis of the bit and is positioned between the gage 6 of the bit and across the face of the bit. The hard coating at 5 extends to form the gage 6.

Sockets 7 are positioned in the coating 3 spaced as herein described in the face 4 in accordance with a pattern for the purposes herein described. The cutters 8 are mounted in the receptacles 9 carried on studs 14 positioned in sockets 7. We prefer, especially where the cutters are mounted in studs as described below, to form the face of the bit in steps 26 extending circumambiently about the face of the bit. The steps extend as a spiral from an intermediate portion 10 of the bit 1 to the portion of the face of the bit adjacent the gage 6, as will be more fully described below. The sockets in the case of the bit shown in said copending application and in FIGS. 1–7, are formed in the angle between land 31 of one step and the rise 30 of the adjacent step.

Each of the cutters is positioned in a stud-mounted receptacle. The studs 14 are formed with a receptacle 9 whose axis 16 is at an obtuse angle to the central axis of the stud 14. The stud is formed of steel or material of similar physical properties and is coated with a hard surface coating 18 formed, for example, of material of the same kind as is used in the coating 3. The stud may be held securely in the socket by an interference fit or by brazing or other means of securing the stud in the socket.

Secured in the receptacles as by soldering or brazing are preform cutters 8 formed as described above. They may be of any desired geometric configuration to fit into the receptacle. For convenience, we prefer cylindrical wafers whose axial dimension is but a minor fraction of the diameter of the wafer. The acute angle 20 between the central axis of the preform and the perpendicular to the axis of the stud 14, establishes a negative vertical cutting rake.

The studs 14 are provided with indexing means, for example, flat sections 21 (FIG. 4) so as to orient the studs as is described below. Positioned in the sockets 7 are means which cooperate with indexing means on the studs, for example, the flat section 22. (FIG. 4) The indexing means are arranged to position the studs in a longitudinal array extending from adjacent the gage 6 across the face 4 towards the axis of the bit.

Figure 2:
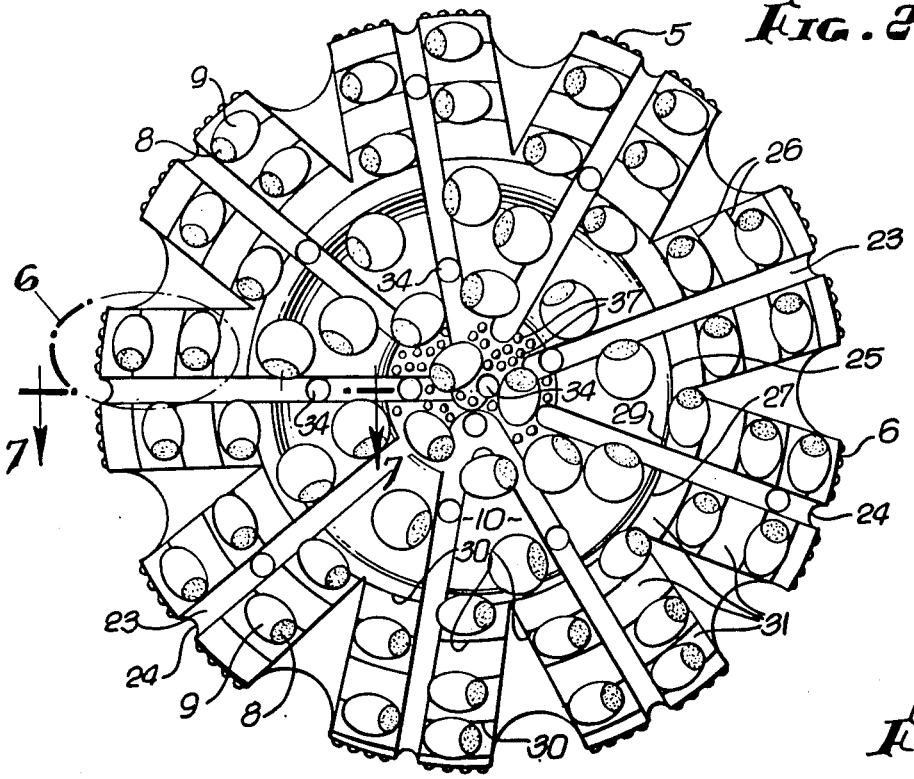
FIG. 2 is a plan view of the bottom of the bit taken on line 2—2 of FIG. 1.

The said arrays positions the studs in a substantially spiral formation in longitudinal arrays extending from the central portion of the bit to adjacent the gage of the bit. The aforesaid longitudinal arrays extend circumambiently about the bit spaced from each other as is illustrated in FIGS. 1 and 2. The arrays are separated by fluid channels 23 which extend from the central portion 10 of the bit to the gage 6 of the bit at the stabilizer section 5 where it joins the grooves 24. The studs are positioned in each array spaced from each other in said arrays. The cutters are arranged in each longitudinal array so that they are in staggered position with respect of the cutters in adjacent array. The cutters overlap each other in the sense that the portion of the earth, not traversed by a cutter of one array, is traversed by a cutter in a following array during rotation.

The indexing flats in the socket and stud are positioned so that the cutting face of the preform cutters in each array face in the same angular direction as the intended direction of rotation of the bit. The bit is designed for rotation in the usual manner by a clockwise rotation of the drilling string connected to the collar 2.

This arrangement assures that all sections of the surface to be cut by the bit are traversed by a series of cutters during each rotation of the bit.

A preferred arrangement is to position the sockets and studs in a generally spiral configuration extending from the center of the bit to the gage, such as multiple spiral starts uniformly spaced angularly from each other.

The form is shown in FIGS. 1 and 2; the face is formed with a central portion 10 having a substantially circular perimeter 25. The portion of the face of the bit extending from the perimeter 25 to the gage 6 of the bit is formed with steps 26 in a spiral configuration. As is shown in FIG. 2, the spiral 27 starts at the tangent 29 at the rise 30 and traverses the face 4 as a spiral to form the lands 31.

The sockets 7 are formed in the face of the bit with the axis of the major portion of the sockets intersecting the apex of the angle between the rise and the land of the steps. The geometry of this arrangement allows the bit to constitute a jig to assure that the sockets will be in a spiral configuration. It is to be noted, however, that a substantial number of the sockets, as in the central portion of the bit, are not located with the axis intersecting the apex of the angle between the rise and land of the steps.

The positioning of the studs in the angle between the rise and the land aids in the protection of the preform. Impact loads are absorbed by the lands and rises where the studs are located.

As a result of this arrangement, on rotation of the bit, the preform cutter elements follow each other to cut the spaces which had been missed by the cutters of the preceding array. The result is that all portions of the earth are traversed by a series of cutters during each rotation.

In order to facilitate the cleaning of the bit and prevent clogging between the cutters, we provide, as described above, fluid channels 23 to join the grooves 24 in the stabilizer section. The fluid channels are in the form of grooves positioned between adjacent longitudinal arrays of cutters and extending adjacent to the face of the cutters in the array. Nozzles 34 (see FIGS. 1, 2, and 7) are positioned in the body of the face to connect with each channel. The nozzles are connected by bores 35 with the central tubular bore of the shank 1. They are positioned at various radial distances from the center around the bit in a generally spiral arrangement.

The flushing action of the fluid in the channels 23 may be sufficient to clean the cutters and prevent clogging. In such case, the face of the cutters may be set at a zero rake, that is, perpendicular to the direction of rotation or with the negative side rake described below. Drilling fluid, conventionally used, is discharged from the nozzles 34 into the channels 23 to flush cuttings, and flows upwardly by the stabilizer 5 directed by grooves 24 through the annulus between the drill string and the bore-hole wall to the surface.

Figure 3:
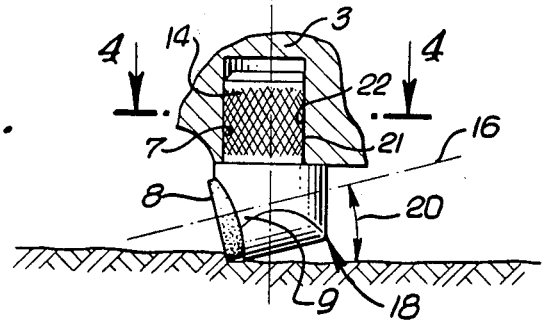
FIG. 3 is a fragmentary section taken on line 3—3 of FIG. 1 with parts in elevation.
Figure 6:
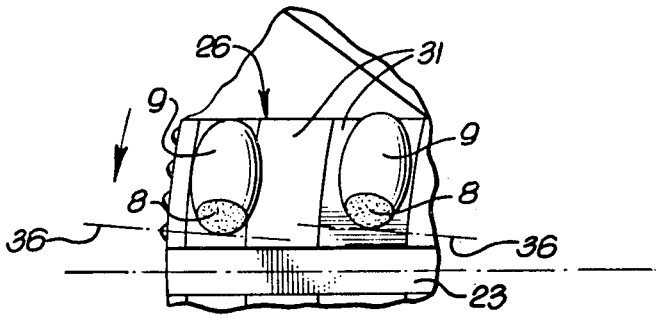
FIG. 6 is a fragmentary detail of FIG. 2 showing the side rake.
Figure 7:
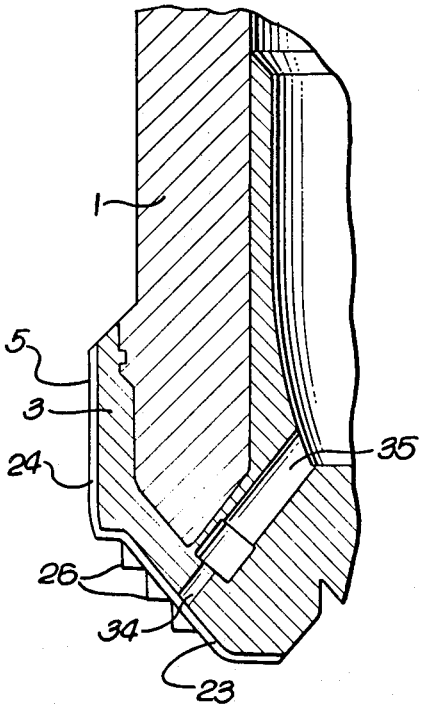
FIG. 7 is a fragmentary section taken on line 7—7 of FIG. 2.

To facilitate the discharge of the cuttings and to clean the bit, the cutters, in addition to the vertical negative rake shown in FIG. 3, may be set in a horizontal rake as shown in FIG. 6. In order to assist in moving the cutting to the gage 6 of the bit, we prefer to orient the cutters so that the cutting surfaces of the preform cutters 8 are rotated about a vertical axis counterclockwise to provide a negative sideways rake 36. (See FIG. 6.)

The negative horizontal rake angle 36 may be, for example, about 1° to 10°, preferably about 2°. The effect of the negative sideways rake is to introduce a snowplow effect and to move the cuttings to the gage of the bit where they may be picked up by the circulating fluid and carried up the grooves 24 of the stabilizer 5. The vertical negative rake angle 20 may be from about 4° to about 20°.

As will be seen, the space taken by the receptacle and the preforms makes impractical the positioning of a large multiple of preform cuttings elements at the center of the bit. The portion may thus produce a core. This is aggravated if any of the preforms are lost from the central portion because of damage occurring during use.

We prefer to supplement the cutting effect at the center by including diamonds 37, either in a pattern or in random distribution. We also provide for diamonds positioned at the gage where the side impacts during drilling are large, employing conventional techniques in setting the diamonds as described above.

For practical reasons, this portion of the bit is first formed before setting of the preform cutters.

One of the features of the above construction is that, should any one or more of the preform cutters by destroyed or the studs damaged, they may be removed; and a new stud and preform may be inserted.

We claim:

1. An earth-boring bit comprising a metallic shank, having a tubular bore, one end of said shank coated with a hard material bonded to said end and forming a face of said bit, circumambient steps extending across the face of said bit from the central portion of the bit to adjacent the gage of the bit, said steps including a rise and a land, sockets in said hard material of said face positioned between a rise and a land of said steps, preform cutters mounted in said sockets in a plurality of longitudinal arrays spaced from each other about said face, each of said cutters including a plurality of abrasive particles bonded into a preform, said preform cutters formed with a cutting face and back.

2. The bit of claim 1, a number of said sockets being positioned between said rise and land of said steps.

3. The bit of claim 1, diamonds positioned at the central portion and the gage of the bit.

4. The bit of claim 1, means on said studs and sockets to position the faces of the preforms substantially in the same angular direction.

5. The bit of claim 1, said preforms being of shape to fit into said sockets with the back of said cutters supported by said sockets in thrust transfer relation to said face of said bit at said steps, the cutting faces of the cutters in all of the arrays facing in the same angular direction.

6. The bit of claim 5, diamonds positioned at the central portion of said bit and at the gage of said bit.

7. The bit of claim 5, said steps extending in substantially spiral formation from adjacent the central portion of the bit to adjacent the gage of said bit and the said cutters extending in said arrays in substantially spiral formation across the face of the bit.

8. The bit of claim 7, diamonds positioned at the central portion of the bit and at the gage of the bit.

9. An earth-boring bit comprising a metallic shank, having a tubular bore, one end of said shank coated with a hard material bonded to said end and forming a face of said bit, steps including a rise and a land extending in a substantially spiral formation from adjacent the central portion of said bit to adjacent the gage of the bit, sockets in said hard material of said face positioned at a rise and a land of said steps, preform cutters mounted in said sockets in a plurality of longitudinal arrays spaced from each other about said face, each of said cutters including a plurality of abrasive particles bonded into a preform, said preform cutters formed with a cutting face and back.

10. The bit of claim 9, diamonds positioned at the central portion of said bit and at the gage of said bit.

11. The bit of claim 9, a number of said sockets being positioned between said rise and land of said steps.

12. The bit of claim 9, diamonds positioned at the central portion and the gage of the bit.

13. The bit of claim 9, means on said studs and sockets to position the faces of the preforms substantially in the same angular direction.

14. The bit of claim 9, said preforms being of shape to fit into said sockets with the back of said cutters supported by said sockets in thrust transfer relation to said face of said bit at said steps, the cutting faces of the cutters in all of the arrays facing in the same angular direction.

15. The bit of claim 14, diamonds positioned at the central portion of said bit and at the gage of said bit.

16. The bit of claim 14, said steps extending in substantially spiral formation from adjacent the central portion of the bit to adjacent the gage of said bit and the said cutters extending in said arrays in substantially spiral formation across the face of the bit.

17. The bit of claim 16, diamonds positioned at the central portion of the bit and at the gage of the bit.

18. An earth-boring drill bit comprising a metallic shank having a tubular bore, one end of said shank coated with a hard material bonded to said end and forming a face of said bit, steps extending circumambiently in said face from adjacent the central portion of said bit to adjacent the gage of said bit, said steps including a rise and a land, sockets positioned between a land and a rise of said steps, studs in said sockets, said studs carrying receptacles, preformed cutters positioned in said receptacles, said studs and cutters being arranged in longitudinal arrays spaced from each other and extending across the face of said bit, in staggered overlapping relation to the cutters in adjacent arrays, said cutters having a cutting face and a back, the back of said cutter supported in said receptacle in thrust transfer relation to said face of said bit at said steps, the cutting faces of said cutters in all of the arrays facing in the same angular direction.

19. The bit of claim 18, a number of said sockets being positioned at the apex between said lands and rise of said steps.

20. The bit of claim 18, diamonds positioned at the central portion of said bit and at the gage of said bit.

21. The bit of claim 18, said steps extending in spiral formation from adjacent the central portion of said bit to adjacent the gage of the bit.

22. The bit of claim 21, diamonds positioned at the central portion of said bit and at the gage of said bit.

23. The earth-boring drill bit of claim 18, a plurality of fluid channels positioned in said face and extending to the gage of said bit, said fluid channels communicating with the said tubular bore.

24. The bit of claim 23, diamonds positioned at the central portion of said bit and at the gage of said bit.

25. An earth-boring drill bit comprising a metallic shank having a tubular bore, one end of said shank coated with a hard material bonded to said end and forming a face of said bit, steps extending in substantially spiral formation in said face from adjacent the central portion of said bit to adjacent the gage of said bit, said steps including a rise and a land, cutters positioned in a substantially spiral formation from the adjacent central portion of said bit to adjacent the gage of said bit, sockets positioned between a land and a rise of said steps, studs in said sockets, said studs carrying receptacles, preformed cutters positioned in said receptacles, said studs and cutters being arranged in longitudinal arrays spaced from each other and extending across the face of said bit, in staggered overlapping relation to the cutters in adjacent arrays, said cutters having a cutting face and a back, the back of said cutter supported in said receptacle in thrust transfer relation to said face of said bit at said steps, the cutting faces of said cutters in all of the arrays facing in the same angular direction.

26. The bit of claim 25, diamonds at the central portion of said bit and at the gage of said bit.

27. The bit of claim 25, a number of said sockets being positioned at the apex between said lands and rise of said steps.

28. The bit of claim 25, diamonds positioned at the central portion of said bit and at the gage of said bit.

29. The bit of claim 25, said preforms extending in spiral formation from adjacent the central portion of said bit to adjacent the gage of the bit.

30. The bit of claim 29, diamonds positioned at the central portion of said bit and at the gage of said bit.

31. The earth-boring drill bit of claim 25, a plurality of fluid channels positioned in said face and extending to the gage of said bit, said fluid channels communicating with the said tubular bore.

32. The bit of claim 31, diamonds positioned at the central portion of said bit and at the gage of said bit.

* * * * *